United States Patent [19]

Kubert et al.

[11] Patent Number: 5,019,868

[45] Date of Patent: May 28, 1991

[54] DEVELOPER ELECTRODE AND REVERSE ROLLER ASSEMBLY FOR HIGH SPEED ELECTROPHOTOGRAPHIC PRINTING DEVICE

[75] Inventors: Vincent T. Kubert, Melbourne, Fla.; Matthew J. Olenski; Mark F. Duchesne, both of Dayton, Ohio

[73] Assignee: AM International, Inc., Chicago, Ill.

[21] Appl. No.: 457,195

[22] Filed: Dec. 28, 1989

[51] Int. Cl.[5] ..... G03G 15/01; G03G 15/10

[52] U.S. Cl. ..... 355/264; 355/256; 355/326; 101/171

[58] Field of Search ..... 355/264, 256, 261, 326, 355/327; 118/647, 648, 645, 662; 101/171-175, 212-217, DIG. 37, DIG. 39

[56] References Cited

U.S. PATENT DOCUMENTS

| | | | |
|---|---|---|---|
| 3,015,340 | 1/1962 | Montz et al. | 137/124 |
| 3,599,070 | 8/1971 | Davis et al. | 320/5 |
| 3,698,926 | 10/1972 | Furuichi | 117/17.5 |
| 3,736,103 | 5/1973 | Stibbe | 23/277 |
| 3,739,491 | 6/1973 | Creapo et al. | 34/156 |
| 3,776,440 | 12/1973 | Frost et al. | 226/97 |
| 3,791,345 | 2/1974 | McCutcheon | 355/261 X |
| 3,873,013 | 3/1975 | Stibbe | 226/97 |
| 3,907,423 | 9/1975 | Hayashi et al. | 355/10 |
| 3,949,703 | 4/1976 | Smith et al. | 118/648 |
| 3,964,656 | 6/1976 | Hella | 226/97 |
| 4,021,586 | 5/1977 | Matkan | 427/17 |
| 4,052,959 | 10/1977 | Hayashi et al. | 118/644 |
| 4,116,620 | 9/1978 | Stibbe | 432/59 |
| 4,160,593 | 7/1979 | Rosenburgh | 355/264 X |
| 4,177,730 | 12/1979 | Schriber et al. | 101/248 |
| 4,182,472 | 1/1980 | Peekna | 226/97 |
| 4,197,971 | 4/1980 | Stibbe | 226/97 |
| 4,197,972 | 4/1980 | Daane | 226/97 |
| 4,197,973 | 4/1980 | Daane | 226/97 |
| 4,201,323 | 5/1980 | Stibbe et al. | 226/97 |
| 4,220,699 | 9/1980 | Ishida et al. | 430/126 |
| 4,265,384 | 5/1981 | Daane | 226/97 |
| 4,282,998 | 8/1981 | Peekna | 226/97 |
| 4,286,039 | 8/1981 | Landa et al. | 430/119 |
| 4,288,015 | 9/1981 | Curtin | 226/97 |
| 4,295,383 | 10/1981 | Frost | 474/83 |
| 4,310,238 | 1/1982 | Mochizuki et al. | 355/14 |
| 4,325,627 | 4/1982 | Swidler et al. | 355/10 |
| 4,343,769 | 8/1982 | Henkelmann | 422/109 |
| 4,369,584 | 1/1983 | Daane | 34/12 |
| 4,398,818 | 8/1983 | Jeromin et al. | 355/261 X |
| 4,399,203 | 8/1983 | Bennett | 429/191 |
| 4,425,719 | 1/1984 | Klein et al. | 34/156 |
| 4,455,562 | 6/1984 | Dolan et al. | 346/154 |
| 4,462,169 | 7/1984 | Daane | 34/62 |
| 4,474,496 | 10/1984 | Rocheleau | 432/59 |
| 4,480,859 | 11/1984 | Rueckl et al. | 285/163 |
| 4,482,624 | 11/1984 | Arney et al. | 430/138 |
| 4,515,292 | 5/1985 | Koos, Jr. | 222/52 |
| 4,529,295 | 7/1985 | Mayer | 355/264 X |
| 4,563,086 | 1/1986 | Knapp et al. | 355/14 |
| 4,601,259 | 7/1986 | Yamashita | 118/658 |
| 4,631,244 | 12/1986 | Mitchell | 430/137 |
| 4,702,985 | 10/1987 | Larson | 430/115 |
| 4,734,737 | 3/1988 | Koichi | 355/14 |
| 4,760,423 | 7/1988 | Holtje et al. | 355/3 |
| 4,827,315 | 5/1989 | Wolfberg et al. | 346/160 |
| 4,828,956 | 5/1989 | Creatura et al. | 430/137 |
| 4,829,336 | 5/1989 | Champion et al. | 355/246 |
| 4,848,633 | 7/1989 | Hagen et al. | 226/97 |
| 4,860,924 | 8/1989 | Simms et al. | 222/56 |

*Primary Examiner*—R. L. Moses

*Attorney, Agent, or Firm*—Biebel & French

[57] ABSTRACT

A developer electrode and reverse roller assembly are provided for use in conjunction with the rotatable print cylinder of a high speed electrophotographic printing press. The normal tendency of toner particles to stick to the developer electrode is inhibited due to the velocity by which toner dispersion is fed to the developer electrode. A pair of slots formed in the electrode face ensure that uniform amount and constituency of the dispersion are supplied to the print cylinder. Both the developer electrode and reverse roller assembly are pivotally mounted adjacent the cylinder with the reverse roller comprising a location sensor to sense reverse roller position and to stop the print cylinder when the reverse roller is not in proper position.

41 Claims, 6 Drawing Sheets

DEVELOPER ELECTRODE AND REVERSE ROLLER ASSEMBLY FOR HIGH SPEED ELECTROPHOTOGRAPHIC PRINTING DEVICE

FIELD OF THE INVENTION

The present invention pertains to a high speed electrophotographic printing press and specifically to a developer electrode and reverse roller assembly therefor.

BACKGROUND OF THE INVENTION

Electrophotographic printing is well known and has been widely refined. For example, today, almost every office and indeed some homes have electrophotographic copiers. The industry has grown to the point where it is now a highly competitive multi-billion dollar industry. In most instances, these home and office copiers are capable of providing only about a few copies per minute.

In electrophotography, images are photoelectrically formed on a photoconductive layer mounted on a conductive base. Liquid or dry developer or toner mixtures may be used to develop the requisite image.

Liquid toner dispersions for use in the process are formed by dispersing dyes or pigments and natural or synthetic resin materials in a highly insulating, low dielectric constant carrier liquid. Charge control agents are added to the liquid toner dispersions to aid in charging the pigment and dye particles to the requisite polarity for proper image formation on the desired substrate.

The photoconductive layer is sensitized by electrical charging whereby electrical charges are uniformly distributed over the surface. The photoconductive layer is then exposed by projecting or alternatively by writing over the surface with a laser, L.E.D., or the like. The electrical charges on the photoconductive layer are conducted away from the areas exposed to light with an electrostatic charge remaining in the image area. The charged pigment and/or dye particles from the liquid toner dispersion contact and adhere to the image areas of the photoconductive layer. The image is then transferred to the desired substrate, such as a travelling web of paper or the like.

In contrast to office and home copiers, high speed electrophotographic printing presses are being developed wherein successive images are rapidly formed on the photoconductive medium for rapid transfer to carrier sheets or the like travelling at speeds of greater than 100 ft./min. and even at speeds of from 300–500 ft./min.

A development shoe or electrode is spaced close to the photoconductive surface and acts as a reservoir holding the liquid toner dispersion for application thereof to the photoconductive layer. In one type of electrophotographic printing system, the image portion of the photoconductive layer has a charge of high potential and given polarity with the non-image areas, due to exposure thereof, carrying a charge potential of lesser magnitude than the image area charge but of common polarity therewith. The solids, color imparting particles in the liquid toner dispersion comprise a charge of opposite polarity. Accordingly, an electrical field is created from the image areas to the non-image areas with the oppositely charged solids, color-imparting particles of the toner dispersion rapidly migrating in the opposite direction, i.e., toward the image areas.

The developer shoe or electrode is provided with an electrical charge having a potential intermediate that supplied to the image and non-image areas and having a common polarity with those area charges. Thus, an electrical field is created in the direction of the developer electrode to the non-image areas with toner particles located in the non-image areas being drawn to the developer electrode. In normal office or home photocopiers, in order to inhibit agglomeration of the charged solids toner particles on the developer shoe, periodically, for instance, between running of each individual copy, a reversing circuit reverses the charge polarity on the developer electrode.

Unfortunately, in high speed electrophotographic copiers of the type herein contemplated, the process cannot be frequently interrupted if the high speed goals of the press are to be attained. Accordingly, there is a need in the art to provide a mechanism in which toner particle agglomeration on the developer shoe can be inhibited or minimized without shutting down or frequently interrupting the continuous process.

Further, due to the high speed nature of the process, it is necessary to ensure that a sufficient supply of liquid toner dispersion is applied uniformly and in sufficient quantity to the rapidly rotating (e.g., 100 ft./min–500 ft./min. peripheral speed) photoconductive cylinder. This is especially important in that the solids particles of the dispersion are rapidly depleted in order to form the required image as the cylinder continues its rapid rotation.

Moreover, it is also desirable to provide for a movable mounting of the developer electrode in its position next to the rotating cylinder so that, if necessary, during machine down-time, the electrode can be easily displaced from its normal operating position to facilitate repair and cleaning thereof.

In addition to the above, it is highly desirable to provide a reverse roller downstream from the development electrode that acts to shear excess toner from the rotating photoconductive drum. This is important since excessive amounts of toner on the cylinder that are subsequently transferred to a travelling carrier web or the like will result in inordinate amounts of noxious vapors being released in downstream drying and fusing operations, and possibly to the surrounding environment. For this reason, it is desirable to provide a sensor or the like in operative association with the reverse roller that will sense when same is not in its proper position, and send a signal to the machine operator or prohibit rotation of the electrophotoconductive drum altogether.

PRIOR ART

In U.S. Pat. No. 4,827,309 (Kato), a developing head is provided under a latent image carrier of the rotating drum or moving plate type. The developing head comprises a plurality of fountain slit and discharge slits arranged alternately and in parallel to each other. The fountain and discharge slits extend laterally across the latent image developing surface. A foraminous pipe is disposed under each of the fountain slits to provide a jet of toner liquid thereto.

Liquid toner is electrostatically attracted to a transport belt or the like to transport the toner to the latent image development area in U.S. Pat. No. 4,021,586 (Matkan). Liquid toner developer shoes and associated reverse roller mechanisms are disclosed in U.S. Pat. Nos. 3,907,423 (Hayashi et al) and 4,052,959 (Hayashi et al).

Despite the prior art methods and mechanisms, there remains a need in the art to provide a developer electrode and associated reverse roller assembly that meet the above-identified needs for minimizing toner agglomeration on the developer electrode, for sensing the position of the reverse roller, and for providing easy access to both the developer electrode and reverse roller for repair and cleaning.

SUMMARY OF THE INVENTION

In accordance with the invention, a developer electrode and associated reverse roller mechanism are provided that are specifically adapted for use in high speed electrophotographic printing units of the type wherein a photoconductive print cylinder is rotated at peripheral speeds on the order of 100 ft./min. and even at higher speeds such as from 300–500 ft./min.

The developer electrode comprises a housing that has an arcuately shaped face portion adapted for close disposition next to the rotatable photoconductive cylinder surface. The housing includes toner dispersion inlet means and, in communication therewith, feed means for uniformly applying liquid toner dispersion over the cylinder. A pump and a controllable flow valve regulate the flow rate of liquid toner dispersion supplied to the developer electrode. Surprisingly, it has been found that if the toner dispersion is supplied to the development shoe at sufficient velocity, the heretofore mentioned tendency of the solids toner particles to stick to or agglomerate to the developer electrode is minimized. Accordingly, the printing press need not be stopped in order to provide a reverse bias to the developer shoe as is the case in some prior art office or home-type photocopiers. Optimal flow rates to the developer shoe have been ascertained to be linearly related to cylinder speed as follows:

| Peripheral Speed of Photoconductive Cylinder | Liquid Toner Dispersion Supply Rate to Developer Electrode |
|---|---|
| 100 ft./min. | 3 gal./min. |
| 300 ft./min. | 9 gal./min. |

In another embodiment of the invention, the developer electrode is pivotally mounted on a pivot shaft by means of support bracket arms. A cam moves the bracket arms around the pivot support so that the developer electrode can be pivoted toward and away from its operable position, i.e., spaced closely adjacent the rotatable cylinder.

The face of the developer shoe comprises a pair of elongated, narrow slots that extend transversely across the cylinder surface. The slots communicate with the toner supply inlet means to ensure that a uniform, sufficient amount of toner dispersion is applied to the rapidly rotating photoconductor surface.

Polyurethane tires are provided on wheels that are journalled in the side panels of the electrode housing. The tires travel on anodized rim tracks formed around the circumference of the photoconductive drum at axial ends thereof and help ensure that a constant gap or spacing is provided between the face of the developer electrode and the cylinder surface.

A reverse roller is located downstream from the developer electrode, and similar to the developer electrode, includes means for imparting an electrical charge of desired potential and polarity thereto. The surface of the reverse roller, adjacent the photoconductive cylinder, rotates in a direction opposite to the rotational direction of the photoconductive cylinder surface and, at that location, acts to shear the excess toner material from the cylinder. The reverse roller is also pivotally mounted adjacent the photoconductive cylinder so that it may be readily moved from its operable, shearing position, to a position where it is farther spaced from the cylinder surface. Additionally, a position sensor senses the position of the reverse roller and sends a signal to a controller means when the reverse roller is not properly positioned, to disconnect drive for the rotating photoconductive cylinder.

The invention will now be further described in conjunction with the following detailed description and the appended drawings. In the drawings:

Brief Description of the Drawings

FIG. 1 is a schematic diagram showing the overall layout of components used to form, develop and transfer an image from a rotatable photoconductive cylinder to a continuous web of paper or the like;

DETAILED DESCRIPTION OF THE PREFERRED EMBODIMENT

Figure 1:
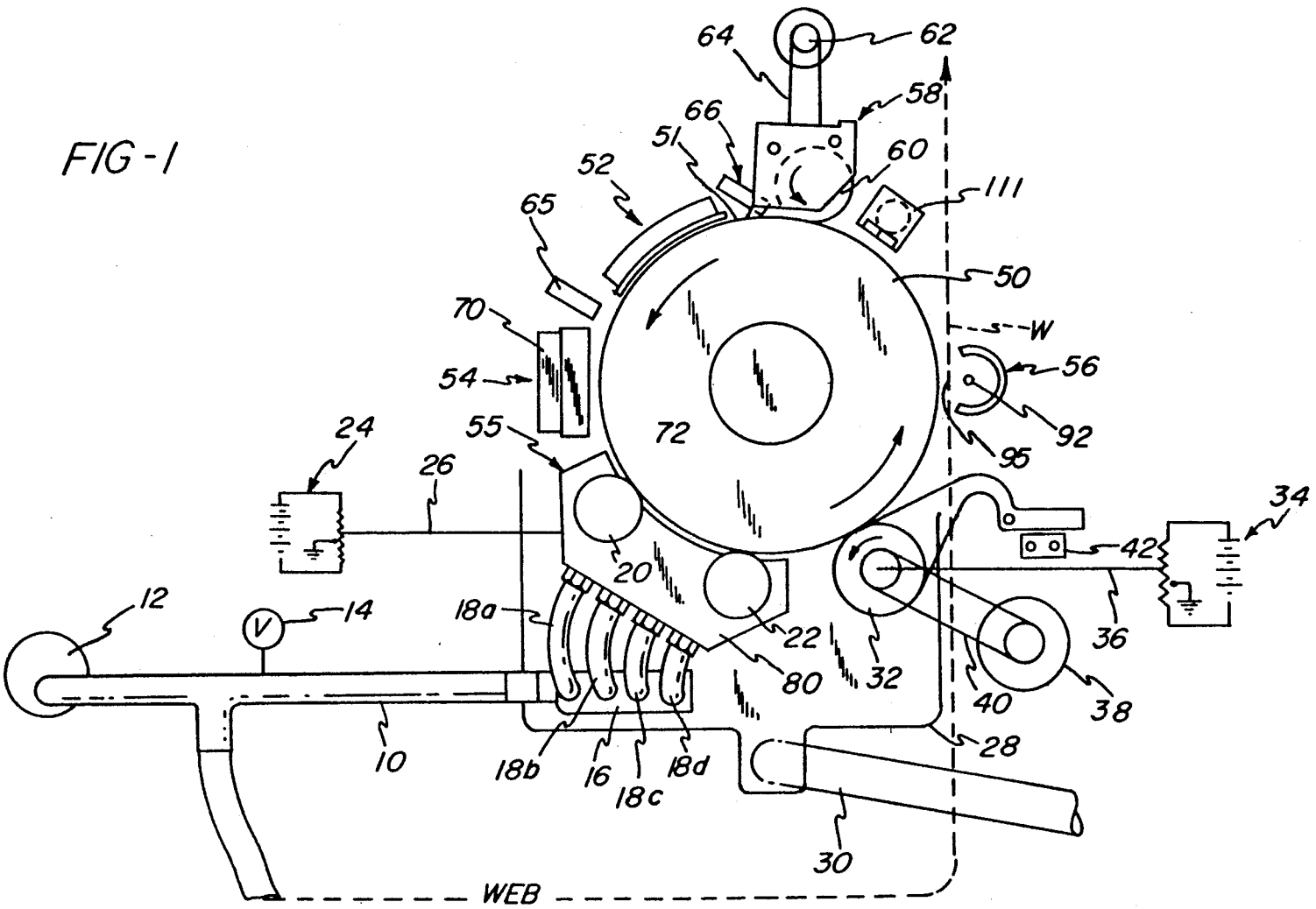

Turning first to the drawings and to FIG. 1 thereof, this view shows the overall organization of a typical photoconductive cylinder and associated mechanisms for formation of the latent electrostatic image, and subsequent image formation on the cylinder surface. A rotatable photoconductive drum 50, typically $As_2$,$Se_3$, SeTe or others, rotates in a counterclockwise direction as indicated by the arrow shown on cylinder 50 in FIG. 1. Special systems are arranged sequentially around drum 50 as shown in FIG. 1, to accomplish the desired formation and transfer of images onto web w. These systems include a high intensity charging apparatus 52, exposing-discharging (or imaging) apparatus 54, developing apparatus 55, transfer apparatus 56 and cleaning apparatus 58. These assure that the drum surface is charged, exposed, discharged and cleared of residual toner, while the developed images are continually transferred to the web material w.

Charging apparatus 52 comprises a plurality of corona discharge devices comprising corona discharge wires disposed within appropriately shaped shielded members with each wire and associated shield member forming a separate focusing chamber. The charge imparted by the coronas to the photoconductive cylinder is on the order of at least +1000 volts d.c., preferably between +1000 and +1450 volts. These corona assemblies extend across the drum surface 51 and along an arc closely parallel to surface 51. In a successful embodiment using a drum having a 33-inch circumference (thus 10.504-inch diameter), the arcuate length of the charging unit is about 4.5 inches or somewhat greater than ⅛ th of the drum circumference.

Proceeding counterclockwise around the drum (as viewed in FIG. 1), there is a charge potential sensor 65 (an electrometer) which senses the voltage at the surface 51 and provides a continuous feedback signal to a charging power supply (not shown) to thereby adjust the charge level of the photoconductor surface 51 regardless of variations due, for example, to irregularities in the power supply or changes in the peripheral velocity of drum 50.

Digital imaging device 54, in the form of relatively high intensity L.E.D. double row array 70 is mounted to extend transversely of the rotating drum surface 51. Each L.E.D. is individually driven from a corresponding driver amplified circuit, details of which need not be described herein. Light emitted from the L.E.D.s is in the range of 655–685 nm through a Selfoc lens 72 onto the drum surface 51 in a dot size of 0.0033 inch diameter. In one successful embodiment, there are a total of 6144 L.E.D.s in the array, divided between two rows which are spaced apart in a direction along the circumference of the surface by 0.010 inch and all fixed to a liquid cooled base block (not shown). The space between adjacent L.E.D.s in the same row is 0.0033 inch horizontally or transverse to the drum surface and the L.E.D. arrays in the two rows are offset horizontally by the same dimension, thus the L.E.D.s can cooperate to discharge a continuous series of dots across drum surface 51 at a resolution of 300 dots/inch.

Light from the L.E.D.s operates to discharge the background or non-image areas of the passing drum surface to a substantially lower potential, for example, in the order of +100 to +300 volts d.c. by exposing individual dot areas to radiation at a predetermined frequency, as mentioned, whereby the remaining or image areas comprise a latent electrostatic image of the printed portions of the form.

Although the use of an L.E.D. arrangement has been depicted herein as providing for the requisite image, other conventional means for forming the requisite image may also be utilized. For instance, laser printing and conventional exposure methods through transparencies and the like may also be utilized, although they are not preferred.

The latent electrostatic image then is carried, as the drum rotates, past developing station 55 where it is subjected to the action of a special high speed liquid toner developer of the type comprising a dielectric carrier liquid material, such as the Isopar series of hydrocarbons, resinous binder particles, and colorimparting dye and/or pigment particles. As is known in the art, the desired charge may be chemically supplied to the resin-pigment/dye particles by utilization of well-known charge control agents such as lecithin and alkylated vinylpyrrolidone materials. In the embodiment shown, drum 50 comprises an $As_2,Se_3$ photoconductive layer to which charge coronas 52 impart a positive charge. The toner particles are accordingly provided with a negative charge in the range of about 60 to 75 picamhos/cm.

The developing station 55 comprises a shoe member 80, which also functions as a developer electrode (which is electrically insulated from drum 50 and extends transversely across drum surface 51). The face of shoe member 80 is curved to conform to a section of drum surface 51 and, in a successful embodiment, has a length, along the arcuate face, of about 7 inches, slightly less than ¼ of the circumference of drum surface 51, and which is closely fitted to the moving drum surface, for example, at a spacing of about 500 microns (0.020 inch). Shoe 80 is divided into first and second cavities 82, 83 (see FIG. 5) through each of which is circulated liquid toner dispersion from a liquid toner dispersion supply and replenishment system.

Liquid toner dispersion is supplied to developer electrode 80 through conduit 10 via action of pump 12 and associated adjustable flow valve 14. The toner dispersion is fed to manifold 16 and then through inlet supply pipes 18(a–d). Polyurethane tires 20, 22 are journalled in the sidewalls of developer electrode housing and ride upon anodized rims that are circumferentially disposed about periphery of drum 50. A direct current source, indicated generally by the reference numeral 24, is provided to apply bias through conductor 26 to the electrode 80.

A toner sump 28 is provided to surround electrode 80 and is provided with a sump return line 30 to return spent toner dispersion to a liquid toner supply system (not shown).

The developer shoe 80 functions as an electrode which is maintained at a potential on the order of about +200 to 600 volts d.c. Thus, the negatively charged toner particles are introduced into the shoe cavities and are dispersed among electrical fields between: 1) the image areas and the developer electrode on the one hand and between 2) the background and the developer electrode on the other hand. Typically, the electrical fields are the result of difference in potential: a) between the images areas (+1000 to 1450 volts) and the developer electrode (+200 to 600 volts) which causes the negatively charged toner particles to deposit on the image areas, and b) the field existing between the background areas (+100 to +300 volts) and the developer electrode (+200 to +600 volts) which later field causes the toner particles to migrate away from the background areas to the developer shoe. The result is a highly distinctive contrast between image and background areas, with good color coverage being provided in the solid image areas. The tendency of toner particles to build up on the developer shoe or electrode is overcome by the circulation of the liquid toner therethrough at rates on the order of about 7.57 to 37.85 liters/min. (2 to 10 gallon/min.) back to the toner refreshing system.

As the drum surface passes from the developer shoe, a reverse rotating metering roll 32, spaced parallel to the drum surface by about 0.002–0.003 in., acts to shear away any loosely attracted toner in the image areas, and also to reduce the amount of volatile carrier liquid carried by the drum and any loose toner particles which might have migrated into the background areas. The metering role has applied to it a bias potential on the order of about +200 to +600 volts d.c. from d.c. power source 34 and conductor 36, varied according to web velocity. Reverse roll 32 is driven via drive roller 38 with drive being transmitted through belt or chain member 40. A position sensor 42 is provided to sense the position of roll 32 as shall be explained in greater detail hereinafter.

Proceeding further in the counterclockwise direction with regard to FIG. 1, there is shown a transfer apparatus 56 adapted to effect transfer of the image from the photoconductive surface to a travelling web w of paper or the like. A pair of idler rollers (not shown) guide web onto the "3 o'clock" position of drum 50 and behind the web path at this location is a transfer coratron 92. The web is driven at a speed equal to the velocity of drum surface 51 to minimize smudging or disturbance of the developed image on the surface 51. The positioning of the idler rollers is such that the width (top to bottom) of the transverse band 95 of web-drum surface contact is about 0.5 inch centered on the radius of the drum which intersects the coratron 92.

The shape of the transfer coratron shield (not shown) and the location of the axis of the tungsten wire are such as to focus an ion "spray" from the coratron onto the web-drum contact band on the reverse side of web w. The transfer coratron 92 has applied to it a voltage in the range of +6600 to +8000 volts d.c., and the distance between the coratron wire and the surface of web w is in the order of about 0.25–0.35 inch - preferably 0.317 inch. This results in a transfer efficiency of at least 95%. Both solid toner particles and liquid carrier material are transferred to the web. The web path continues into a fuser and dryer apparatus (not shown), wherein the carrier liquid is evaporated from the web material and the toner particles are fused thereto.

Proceeding further in the clockwise direction, an erase lamp 111 is arranged to flood surface 51 with either blue or white light emanating from a fluorescent tube. Satisfactory cleaning results have been achieved with blue fluorescent tubes emitting predominantly at about 440 nm and with white fluorescent tubes emitting predominantly at 400, 440, 550 and 575 nm.

A cleaning apparatus 58 follows the erase station and is utilized to remove all residual toner particles and carrier liquid from the drum surfaces.

The foam roller 60 is of a polyurethane open cell construction and is rotated in the opposite direction to drum surface motion, as indicated by the arrows in FIG. 1, so as to compress against and scrub the surface 51. The compression/expansion of the open cell foam during this action will tend to draw liquid carrier material and any included toner particles remaining on the surface 51 off of that surface and into the cells of roller 60. Roller 60 is driven via motor shaft 62 and belt or chain 64.

A cleaning blade 66, comprising a stiff (in a direction across the drum), but flexible (in a direction generally tangent to the drum), polyurethane wiper blade is mounted with its edge extending forward and into contact with surface 51, just downstream of foam roller 60. Blade 66 acts to wipe dry drum surface 51, since the photoconductor surface must be dry when it reaches the charging station.

Figure 2:
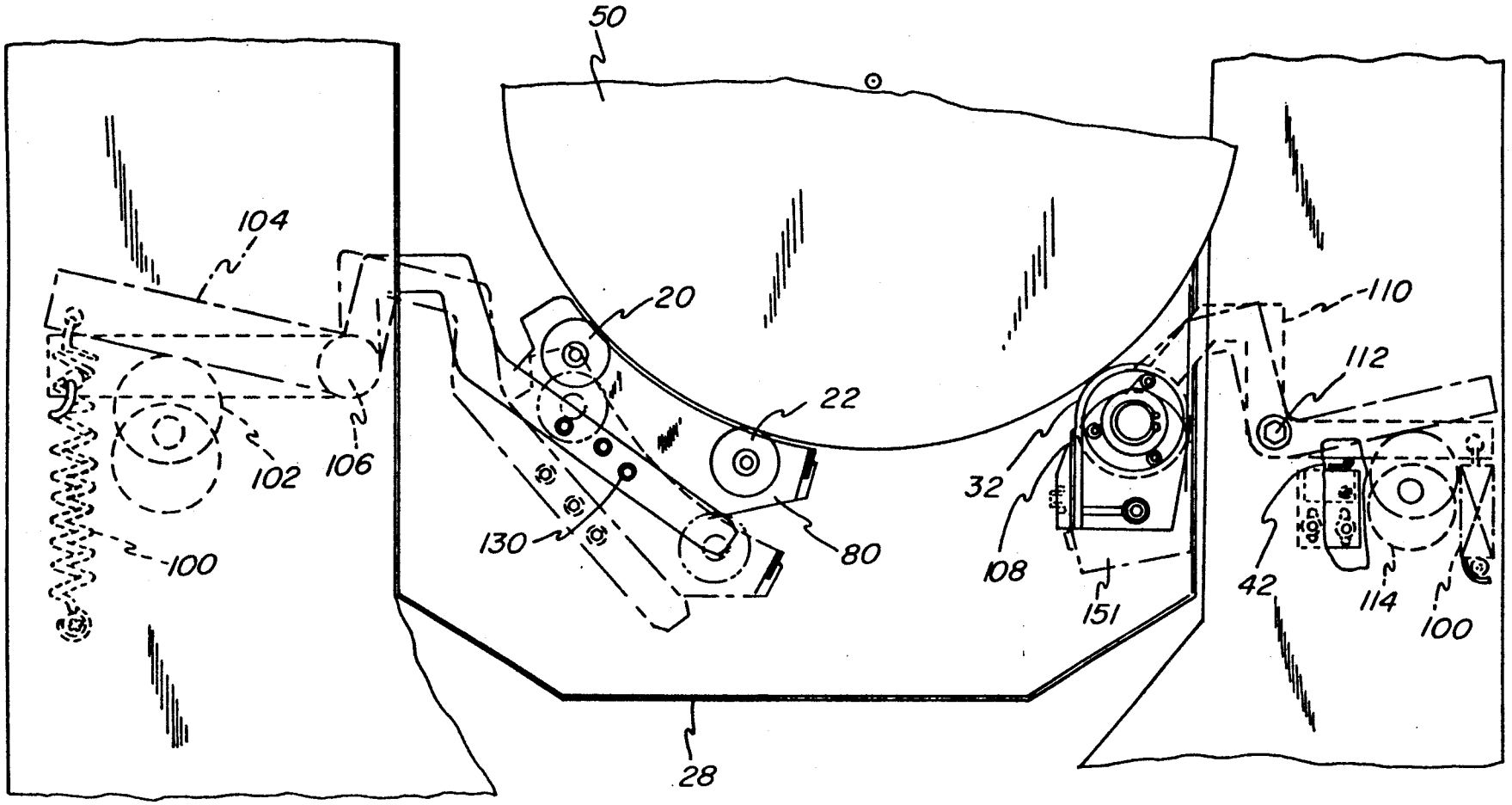
FIG. 2 is a schematic diagram illustrating the developer electrode, and reverse roller assembly and the mounting means therefor.

Turning now to FIG. 2, there is shown developer electrode 80 closely spaced adjacent rotating cylinder 50. Polyurethane tires 20, 22 ride on anodized rim portions of the cylinder 50 which extend around the periphery of the cylinder. Developer shoe 80 is mounted on bracket arm 104 at insulator sleeve location 130. Insulator sleeve 130 provides electrical insulation of the charged electrode 80 from the rest of the apparatus. Bracket arm 104 is pivotally mounted around pivot shaft 106. Pivotal action is actuated by means of cam 102. That is, the arm 104 acts as a follower for cam 102. When the high part of the cam contacts bracket arm 104, the arm swings away from the cylinder as shown in phantom in FIG. 2. A spring 100 attached to the frame biases developer electrode into its operative position spaced closely from cylinder 50 when the low part of the cam contacts cylinder arm 104.

Figure 7:
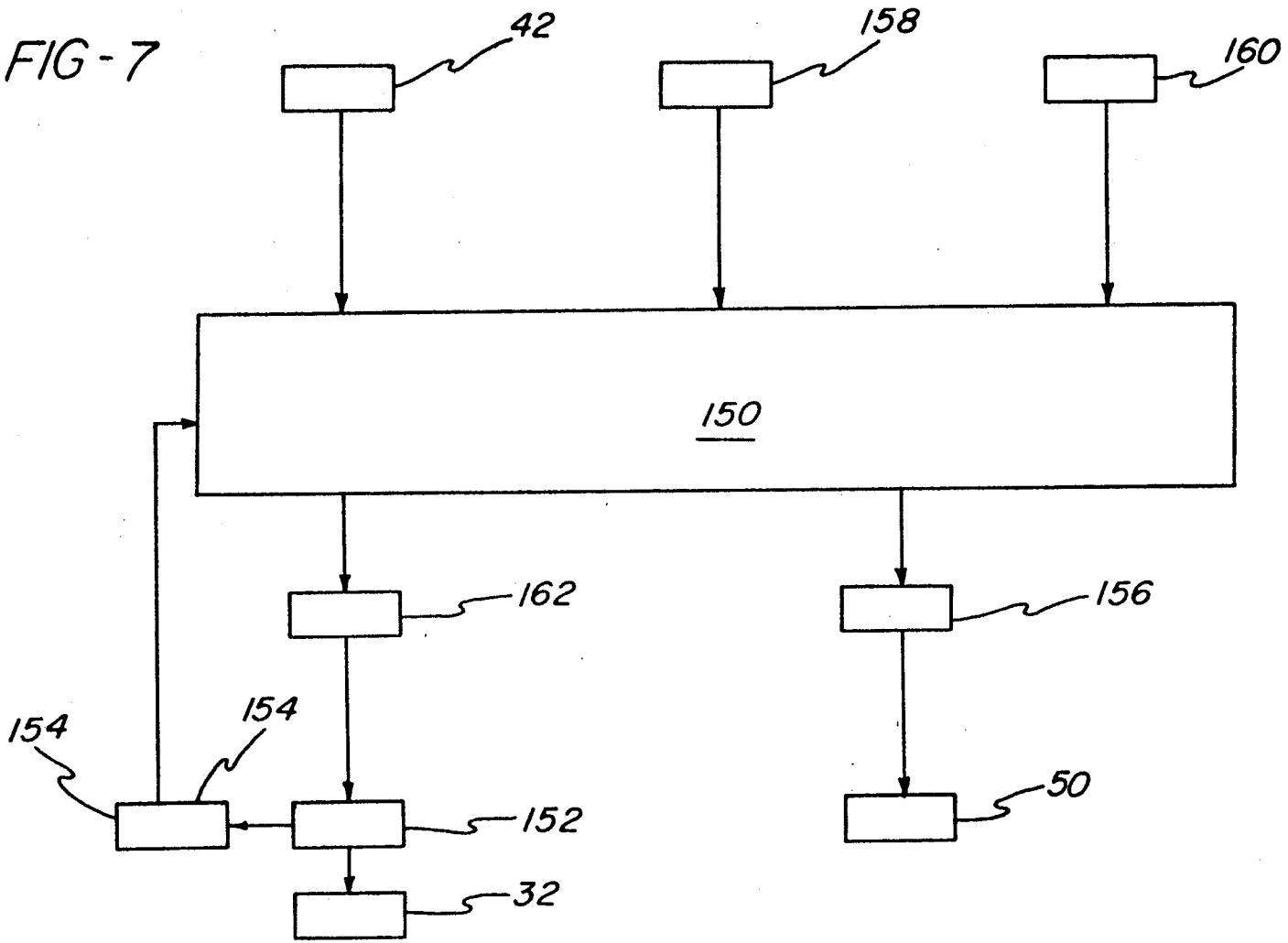
FIG. 7 is a block diagram showing a simplified control circuit for the reverse roller position sensor means, and drive motors for the reverse roller and photoconductive cylinder.

Similarly, reverse roller 32 is mounted to bracket plate 152 secured to bracket arm 110. Bracket arm 110 pivots around pivot shaft 112 and pivotal actuation thereof is achieved by means of cam 114. When the major radius (high part) of cam 114 contacts the arm 112, the bracket plate 152 and reverse roller 32 journalled therein are moved away from their operative position adjacent the cylinder for cleaning and repair purposes. A scraper blade 108 contacts rotating reverse roller 32 and helps to scrape accumulated toner particles therefrom. A sensor 42 senses the location of arm 110. When arm 110 is sensed to be in a position other than in the operative position whereby reverse roller 32 is spaced closely adjacent cylinder 50, sensor 42 sends a signal to programmable logic controller 150 (PLC) to disconnect electric power to drive cylinder 50. (See FIG. 7) Accordingly, this is an important part of the invention in that when the reverse roller 32 is in an improper (inoperative) position to shear excess liquid toner material from the drum 50, sensor 42 acts to actuate stop motion of cylinder 50. Otherwise, excessive toner particles and carrier liquid would travel through the downstream transfer mechanism into the dryer-fuser apparatus wherein excessive carrier liquid volatile materials may present a hazard.

We also insure through the PLC logic that the reverse roller is engaged and is turning before the drum starts turning. In this way, any foreign debris is urged to move away from the reverse roll 32—drum 50 nip. If the drum were started first, a foreign particle could get trapped in the nip causing a long, circumferential scratch before the reverse roll started its rotation.

Returning to FIG. 2, spring 116 normally biases arm 110 and integral bracket plate 151 into the operative position as it acts in contact with the minor radius (low part) of cam 114.

Figure 3:
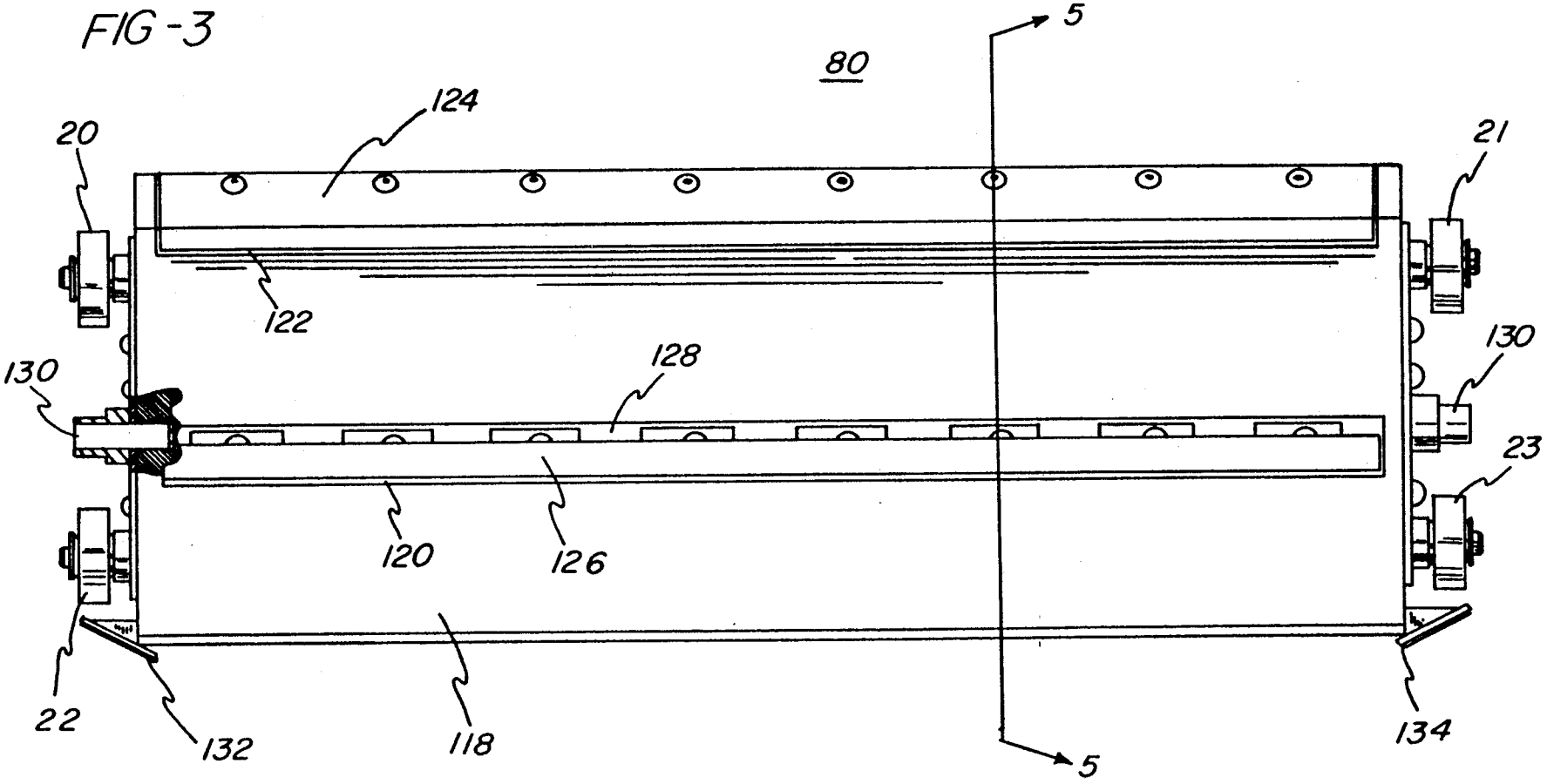
FIG. 3 is a view in elevation showing the face portion of the developer electrode.
Figure 5:
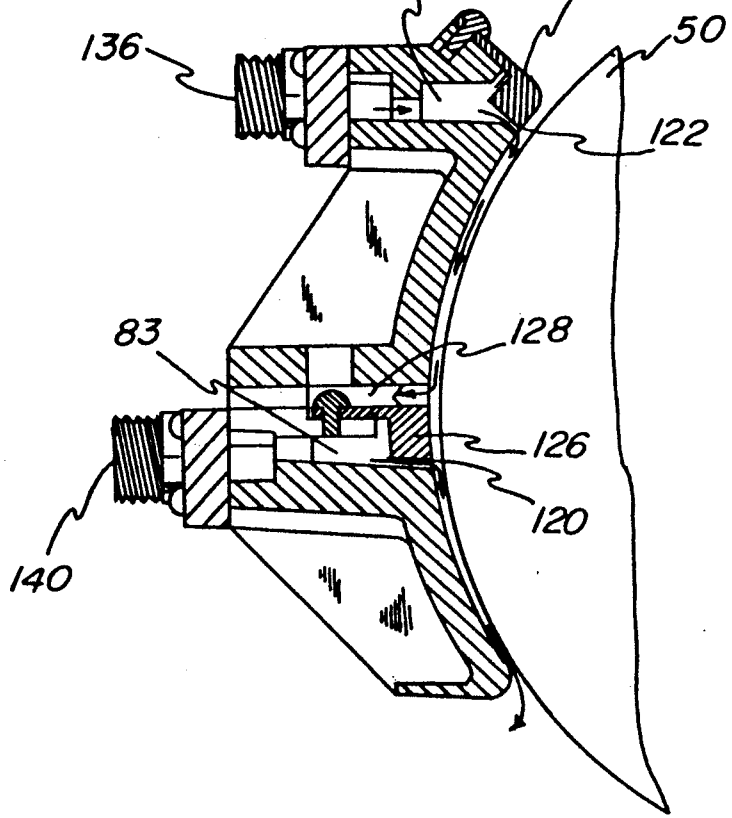
FIG. 5 is a sectional view taken along the lines and arrows 5—5 shown in FIG. 3 showing a section of the developer shoe in its operable position spaced closely to the surface of the photoconductive cylinder.

Turning now to FIGS. 3 and 5 of the invention, FIG. 3 shows the face portion of developer electrode 80. The face portion is arcuately shaped and adapted for close spacing adjacent rotating cylinder 50. Insulator shaft 130 is provided for mounting of the developer electrode to the bracket arms 104 shown in FIG. 2. It will be appreciated that two such bracket arms 104 are present in the apparatus with the arms being connected by pivot shaft 106 (FIG. 2). Polyurethane tires 20, 22, 21 and 23 are provided on shafts which extend through the electrode housing. Conventional bearing means and the like are utilized in operative association with the tire members. These tires ride in and on anodized rim portions circumferentially spaced around cylinder 50. The tires help to maintain the proper gap between the face of electrode 80 and cylinder 50 and compensate for irregularities, such as an out-of-shape cylinder surface. Slots 122, 120 are spaced from each other along the arclengthwise direction of the face (i.e., the rotational direction of cylinder 50) of developer electrode 80 and provide a feed means to supply liquid toner dispersion to the rotating cylinder 50. Gate members 124 and 126 are provided adjacent slots 122, 120 respectively, and are attached to the electrode housing by means of screws or the like. These gate members extend transversely across the face of electrode 80 and serve to restrict flow of liquid toner dispersion from the slots 122, 120. Transversely disposed slot 128 serves as a return for liquid toner dispersion material which is then emptied into the sump 28 (FIG. 1). Scrapers 132, 134 are provided to clean the anodized tracks of the PC drum of toner to provide clean surfaces for the reverse roll support bearings to ride.

Turning to FIG. 5, top inlet 136 is adapted to supply fresh liquid toner dispersion material through developer electrode 80 and onto the surface of rotating drum 50.

Figure 4:
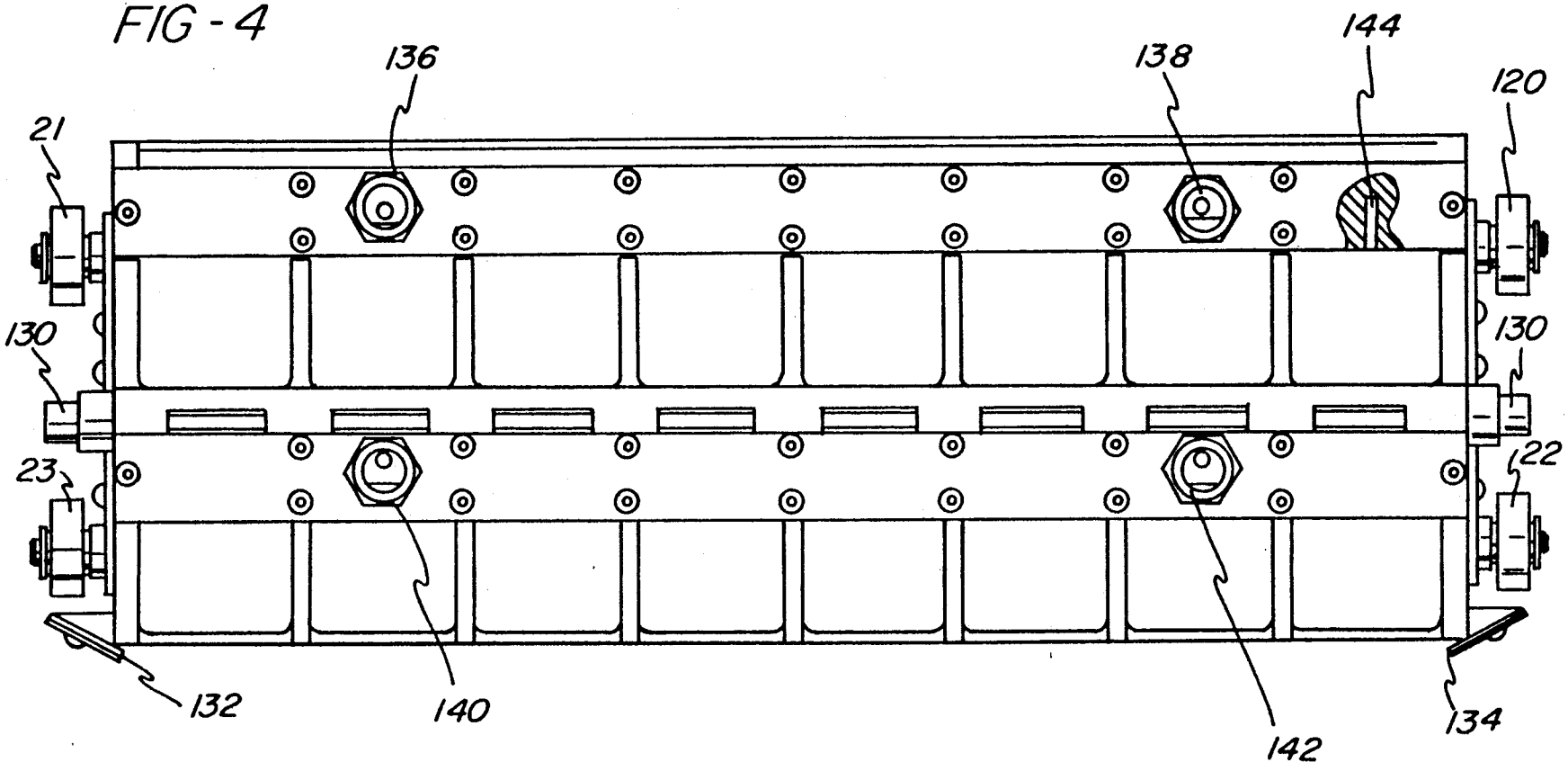
FIG. 4 is a view in elevation showing the back side of the developer shoe.

Turning to FIG. 4, there are shown four inlets 136, 138, 140, 142 by which liquid toner dispersion material is admitted to the electrode 80 for distribution over the surface of rotating cylinder 50 as shall be explained hereinafter.

Turning back to FIG. 5, this is a sectional view taken along the lines and arrows 5—5 of FIG. 3. Here, it can be seen that inlet 136 communicates with chamber 82. Liquid toner dispersion material entering inlet 136 travels into the chamber 82 has its flow restricted via gate member 124 and exits through transverse slot 122. The gate members 124, 126, as shown, slightly cover the slots 122, 120 and thus slightly restrict fluid flow therethrough. There, it travels along the surface of cylinder 50 and, solids color-imparting particles thereof are attracted to image portions formed on the cylinder 50. The remaining liquid toner from slot 122 travelling with drum 50 exits through transverse exit slot 128 and flows into the sump 28 (see FIG. 2). Liquid toner material entering electrode 80 via inlet 140 passes to chamber 83 and then through transverse slot 120 to contact the drum surface 50. As shown in the bottom of FIG. 5, excess liquid toner material fed from slot 120, falls off the bottom portion of drum 50 and then into the sump.

Due to the high speed nature of the printing process, it is important that a uniform amount of liquid toner dispersion material be supplied and applied to the surface of rotating drum 50. As may readily be appreciated, the liquid toner dispersion material is, upon contact with drum 50, rapidly depleted of its solids particles as same are attracted to the image areas on the drum. Accordingly, liquid toner material exiting through groove 128, has a depleted quantity of solids materials therein. It is therefore necessary to provide another feed means, namely, transverse slot 120, to supply fresh liquid toner dispersion material to the drum, so that a fresh supply of liquid toner material of the correct solids content contacts the drum approximate slot 120 so that the desired image can properly be formed on drum 50.

Figure 6:
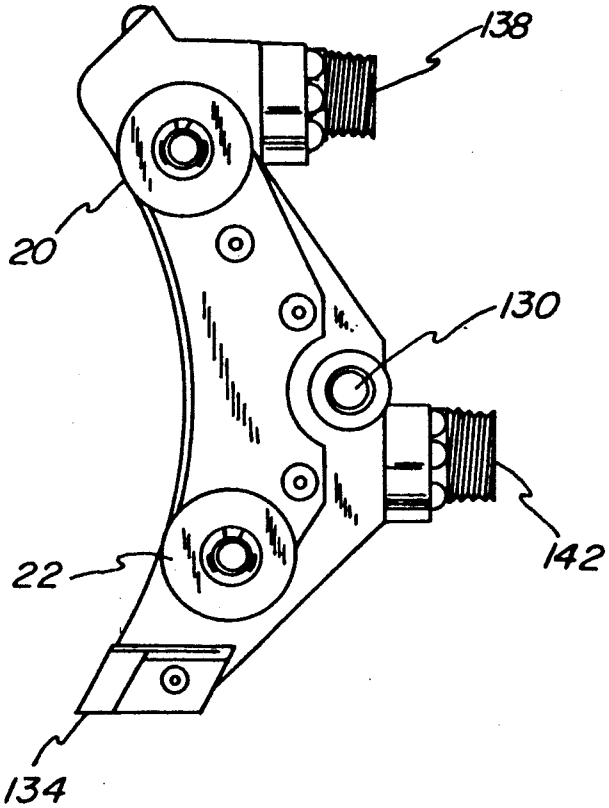
FIG. 6 is a view in elevation showing a side portion of the developer shoe.

With further reference to FIGS. 4–6, it can be seen that inlet 136 and inlet 138 communicate with chamber 82 and that liquid toner dispersion material admitted through inlets 136, 138 passes through the slot 122 into contact with rotating surface of drum 50. Similarly, inlets 140, 142 both communicate with chamber 83 and supply liquid toner dispersion material to cylinder 50 through slot 120. As shown in FIG. 4, a receptacle 144 is provided in the back side portion of electrode 80 to serve as a site for electrical connection to impart the proper bias to the electrode.

In operation and referring again to FIG. 1, pump means 12 and motorized valve 14 cause flow of liquid toner dispersion through conduit 10 into inlet lines 18*a*, 18*b*, 18*c*, and 18*d* and then through inlets 136, 138, 140, 142. Surprisingly, it has been found, through experimentation, that when the drum 50 is travelling at a peripheral speed of about 100 ft./min., a fluid flow to electrode 80 of about 3 gal./min. suffices to inhibit toner particle agglomeration on the parts of electrode 80. The correlation between peripheral speed of drum 50 and fluid flow through line 10 is linear. Accordingly, at a cylinder speed of about 300 ft./min., 9 gal./min. of liquid toner dispersion should be fed via pump 12 and valve 14 through line 10. The liquid toner dispersion is fed to the surface of cylinder 50 through slots 122 and 120 respectively, with excess toner passing through exit slot 128 or from the bottom of the face of electrode 20 into sump 28.

Turning again to FIG. 7 of the drawings, there is shown a schematic control diagram for controlling the drive for photoconductive cylinder 50 and reverse roller 32. As shown, the system includes the reverse roller 32 controlled by a variable speed DC motor 152 with controller 162. Sensor switch 42 indicates if the reverse roller 32 is in its operable position closely spaced from photoconductive cylinder 50 so that it can shear excess toner particles and liquid from the surface of the photoconductive cylinder. The motor controller 162 operates in a speed regulation mode by means of feedback from tachometer 154 operatively associated with motor 152.

A programmable logic controller (PLC) 150 provides the speed reference to the reverse roll motor controller 162 and monitors the tachometer feedback signal. The PLC also monitors the signal from sensor switch 42. An actuator 158 is connected to the PLC so as to actuate rotation of the cylinder 50 with a stop button 160 provided to stop drive for the cylinder.

Before the cylinder 50 rotation can begin, the PLC verifies that the reverse roller 32 is in its normal, operable position. Thereupon, the PLC causes the reverse roller to rotate about three seconds or so before it issues its signal to motor 156 to drive cylinder 50. Once the cylinder rotation commences, the tangential speed of cylinder 50 is brought to a specified speed set point. The PLC then sets the reverse roll speed set point in relation to the surface speed of cylinder 50. More specifically, in normal operation, the tangential speed of reverse roller 32 is set to about 1.2÷1.3 times the tangential speed of cylinder 50. In this manner, optimal "shearing" of the toner is maintained to minimize carryover of the hydrocarbon toner solvent by the web. This, in turn, minimizes the load on the fuser/dryer station of the press (not shown) located downstream from the transfer apparatus 56.

During normal operation, the PLC monitors the feedback signal from tachometer 154 to insure that the tangential speed of the reverse roller 32 is set at the desired speed set point plus or minus a small tolerance factor. If the reverse roll speed is not at this set point or within its tolerance limits, a reverse roll speed fault is detected and motors 152 and 156 are stopped. Additionally, if sensor 42 indicates that the reverse roller 32 is out of its normal operable disposition, motors 152 and 156 are both signalled to stop. During normal operation, the press operator may press stop signal 160 at which time the PLC will first issue a signal for motor 156 to stop followed by an approximate three second delay before reverse roller motor 152 is signalled to stop.

Although this invention has been described with respect to certain preferred embodiments, it will be appreciated that a wide variety of equivalents may be substituted for those specific elements shown and described herein, all without departing from the spirit and scope of the invention as defined in the appended claims.

We claim:

1. High speed electrophotographic printing process of the type including a rotatable cylinder having a photoconductive surface rotating at a peripheral speed of at least about 100 ft./min., wherein a latent electrostatic image is formed on said surface by imparting a first charge of a given polarity and potential over said surface and subsequently exposing non-image areas of said surface to dissipate said first charge in said non-image areas to form a second charge in said non-image areas of lesser potential than and common polarity with said first charge, the improvement comprising:

providing a developer electrode comprising a liquid toner inlet and feed means for supplying a liquid toner dispersion to said surface, said liquid toner dispersion comprising a carrier liquid and, dispersed therein, solids color-imparting particles of opposite polarity than said given polarity, imparting a third charge to said developer electrode of common polarity with said first charge and having a potential intermediate that of said first and second charge, and feeding said liquid toner dispersion to said developer electrode for application to said surface at sufficient velocity to inhibit agglomeration of said solids, color-imparting particles on said developer electrode.

2. Process as recited in claim wherein the feed velocity of said liquid toner dispersion is linearly related to the periphery speed of said cylinder surface.

3. High speed electrophotographic printing process of the type including a rotatable cylinder having a photoconductive surface rotating at a peripheral speed of at least about 100 ft./min., wherein a latent electrostatic image is formed on said surface by imparting a first charge of a given polarity and potential over said surface and subsequently exposing non-image areas of said surface to dissipate said first charge in said non-image areas to form a second charge in said non-image areas of lesser potential than and common polarity with said first charge, the improvement comprising:

providing a developer electrode comprising a liquid toner inlet and feed means for supplying a liquid toner dispersion to said surface, and liquid toner dispersion comprising a carrier liquid and, dispersed therein, solids color-imparting particles of opposite polarity than said given polarity, imparting a third charge to said developer electrode of common polarity with said first charge and having a potential intermediate that of said first and second charge, feeding said liquid toner dispersion to said developer electrode for application to said surface at sufficient velocity to inhibit agglomeration of said solids, color-imparting particles on said developer electrode, and wherein said cylinder surface is rotated at a peripheral speed of about 100 ft./min. and comprising feeding said liquid toner dispersion to said developer electrode at a velocity of at least about 3 gallons per minute.

4. High speed electrophotographic printing process of the type including a rotatable cylinder having a photoconductive surface rotating at a peripheral speed of at least about 100 ft./min., wherein a latent electrostatic image is formed on said surface by imparting a first charge of a given polarity and potential over said surface and subsequently exposing non-image areas of said surface to dissipate said first charge in said non-image areas to form a second charge in said non-image areas of lesser potential than and common polarity with said first charge, the improvement comprising:

providing a developer electrode comprising a liquid toner inlet and feed means for supplying a liquid toner dispersion to said surface, said liquid toner dispersion comprising a carrier liquid and, dispersed therein, solids color-imparting particles of opposite polarity than said given polarity, imparting a third charge to said developer electrode of common polarity with said first charge and having a potential intermediate that of said first and second charge, feeding said liquid toner dispersion to said developer electrode for application to said surface at sufficient velocity to inhibit agglomeration of said solids, color-imparting particles on said developer electrode, and wherein said cylinder surface is rotated at a peripheral speed of about 300 ft./min. and comprising feeding said liquid toner dispersion to said developer electrode at a velocity of at least about 9 gallons per minute.

5. High speed electrophotographic printing process of the type including a rotatable cylinder having a photoconductive surface rotating at a peripheral speed of at least about 100 ft./min., wherein a latent electrostatic image is formed on said surface by imparting a first charge of a given polarity and potential over said surface and subsequently exposing non-image areas of said surface to dissipate said first charge in said non-image areas to form a second charge in said non-image areas of lesser potential than and common polarity with said first charge, the improvement comprising:

providing a developer electrode comprising a liquid toner inlet and feed means for supplying a liquid toner dispersion to said surface, said liquid toner dispersion comprising a carrier liquid and, dispersed therein, solids color-imparting particles of opposite polarity than said given polarity, imparting a third charge to said developer electrode of common polarity with said first charge and having a potential intermediate that of said first and second charge, feeding said liquid toner dispersion to said developer electrode for application to said surface at sufficient velocity to inhibit agglomeration of said solids, color-imparting particles on said developer electrode, and further comprising providing pivotal attachment means for pivotally mounting said developer electrode adjacent said cylinder surface, said pivotal attachment means providing selective, alternate positioning of said development electrode between an operable position in which said developer electrode is closely spaced from said cylinder surface and a second, inoperable position in which developer electrode is distanced farther away from said cylinder surface.

6. High speed electrophotographic printing process of the type including a rotatable cylinder having a photoconductive surface rotating at a peripheral speed of at least about 100 ft./min., wherein a latent electrostatic image is formed on said surface by imparting a first charge of a given polarity and potential over said surface and subsequently exposing non-image areas of said surface to dissipate said first charge in said non-image areas to form a second charge in said non-image areas of lesser potential than and common polarity with said first charge, the improvement comprising:

providing a developer electrode comprising a liquid toner inlet and feed means for supplying a liquid toner dispersion to said surface, said liquid toner dispersion comprising a carrier liquid and, dispersed therein, solids color-imparting particles of opposite polarity than said given polarity, imparting a third charge to said developer electrode of common polarity with said first charge and having a potential intermediate that of said first and second charge, feeding said liquid toner dispersion to said developer electrode for application to said surface at sufficient velocity to inhibit agglomeration of said solids, color-imparting particles on said developer electrode, and further comprising, subsequent to said feeding of said liquid toner dispersion to said cylinder surface, shearing away loosely attracted toner particles and excess carrier liquid from said surface with a reverse roller surface rotating in a direction opposite from said cylinder surface rotational direction.

7. Process as recited in claim 6 comprising imparting a charge to said reverse roller, said reverse roller charge being of common polarity with, but of greater potential than said second charge and having lesser potential than said first charge.

8. Process as recited in claim 6 further comprising providing pivotal attachment means for pivotally mounting said reverse roller adjacent said cylinder, said pivotal attachment means providing selective, alternate positioning of said reverse roller between an operable position in which said reverse roller is positioned to shear excess toner from said surface and an inoperable position in which said reverse roller is spaced farther from said surface than in said operable position.

9. Process as recited in claim 6 further comprising sensing the position of said reverse roller and preventing rotation of said rotatable cylinder in response to sensing a condition wherein said reverse roller is not properly disposed in said operable position.

10. Process as recited in claim 6 further comprising controlling the surface speed of said reverse roller so that it is about 1.2–1.3 times as fast as the surface speed of said rotatable cylinder.

11. High speed electrophotographic printing process of the type including a rotatable cylinder having a photoconductive surface rotating at a peripheral speed of at least about 100 ft./min., wherein a latent electrostatic image is formed on said surface by imparting a first charge of a given polarity and potential over said surface and subsequently exposing non-image areas of said surface to dissipate said first charge in said non-image areas to form a second charge in said non-image areas of lesser potential than and common polarity with said first charge, the improvement comprising:

providing a developer electrode comprising a liquid toner inlet and feed means for supplying a liquid toner dispersion to said surface, said liquid toner dispersion comprising a carrier liquid and, dispersed therein, solids color-imparting particles of opposite polarity than said given polarity, imparting a third charge to said developer electrode of common polarity with said first charge and having a potential intermediate that of said first and second charge, feeding said liquid toner dispersion to said developer electrode for application to said surface at sufficient velocity to inhibit agglomeration of said solids, color-imparting particles on said developer electrode, and further comprising providing a rotatable reverse roller assembly adjacent said cylinder surface adapted to shear excess carrier liquid from said surface and, prior to starting rotation of said cylinder, rotating said reverse roller assembly to clean debris from said cylinder surface.

12. High speed electrophotographic printing apparatus of the type including a rotatable cylinder having a photoconductive surface rotating at a peripheral speed of at least about 100 ft./min. and wherein means are provided for forming, on said surface, a latent electrostatic image by imparting a first charge of a given polarity and potential over said surface and for subsequently exposing non-image areas of said cylinder surface to dissipate said first charge in said non-image areas of said surface to form, in said non-image areas, a second charge of lesser potential than and common polarity with said first charge, the improvement comprising:

developer electrode means comprising a liquid toner inlet means and feed means for supplying a liquid toner dispersion to said cylinder surface, said liquid toner dispersion comprising a carrier liquid, and, dispersed therein, solids, color-imparting particles of opposite polarity than said given polarity, means for imparting a third charge to said developer electrode of common polarity with said first charge and having a potential intermediate that of said first and second charge, and means for feeding said liquid toner dispersion to said developer electrode for application to said cylinder surface at sufficient velocity to inhibit agglomeration of said solids, color-imparting particles on said developer electrode.

13. Apparatus as recited in claim 12 wherein said liquid toner dispersion is fed at a velocity linearly related to the periphery speed of said cylinder surface.

14. High speed electrophotographic printing apparatus of the type including a rotatable cylinder having a photoconductive surface rotating at a peripheral speed of at least about 100 ft./min. and wherein means are provided for forming, on said surface, a latent electrostatic image by imparting a first charge of a given polarity and potential over said surface and for subsequently exposing non-image areas of said cylinder surface to dissipate said first charge in said non-image areas of said surface to form, in said non-image areas, a second charge of lesser potential than and common polarity with said first charge, the improvement comprising:

developer electrode means comprising a liquid toner inlet means and feed means for supplying a liquid toner dispersion to said cylinder surface, said liquid toner dispersion comprising a carrier liquid, and, dispersed therein, solids, color-imparting particles of opposite polarity than said given polarity, means for imparting a third charge to said developer electrode of common polarity with said first charge and having a potential intermediate that of said first and second charge, means for feeding said liquid toner dispersion to said developer electrode for application to said cylinder surface at sufficient velocity to inhibit agglomeration of said solids, color-imparting particles on said developer electrode, and wherein said feed means comprises pump means for pumping said liquid toner dispersion to said inlet means and an adjustable flow control valve in fluid communication with said pump means.

15. Apparatus as recited in claim 14 wherein said feed means comprise a pair of elongated slots in communication with said inlet means, said developer electrode comprising a housing having a generally arcuately shaped face portion closely spaced from and extending transversely across said cylinder surface, said slots extending transversely across said arcuately shaped face and being substantially parallel to the axis of said rotatable cylinder.

16. Apparatus as recited in claim 15 further comprising elongated gate members attached to said developer electrode and extending transversely of said developer electrode adjacent said slots.

17. Apparatus as recited in claim 15 further comprising roller means journalled in said housing for providing rotatable surfaces bearing against and riding along said cylinder surface.

18. Apparatus as recited in claim 17 wherein said roller means comprise a plurality of tire members, said tire members contacting and riding on circumferentially disposed rim portions of said cylinder.

19. High speed electrophotographic printing apparatus of the type including a rotatable cylinder having a photoconductive surface rotating at a peripheral speed of at least about 100 ft./min. and wherein means are provided for forming, on said surface, a latent electrostatic image by imparting a first charge of a given polarity and potential over said surface and for subsequently exposing non-image areas of said cylinder surface to dissipate said first charge in said non-image areas of said surface to form, in said non-image areas, a second charge of lesser potential than and common polarity with said first charge, the improvement comprising:

developer electrode means comprising a liquid toner inlet means and feed means for supplying a liquid toner dispersion to said cylinder surface, said liquid toner dispersion comprising a carrier liquid, and, dispersed therein, solids, color-imparting particles of opposite polarity than said given polarity, means for imparting a third charge to said developer electrode of common polarity with said first charge and having a potential intermediate that of said first and second charge, means for feeding said liquid toner dispersion to said developer electrode for application to said cylinder surface at sufficient velocity to inhibit agglomeration of said solids, color-imparting particles on said developer electrode, and further comprising pivotal attachment means for pivotally mounting said developer electrode adjacent said cylinder surface, said pivotal attachment means providing selective, alternate positioning of said developer electrode between an operable position in which said developer electrode is closely spaced from said cylinder surface and a second, inoperable position in which said developer electrode is distanced farther away from said surface than in said operable position.

20. High speed electrophotographic printing apparatus of the type including a rotatable cylinder having a photoconductive surface rotating at a peripheral speed of at least about 100 ft./min. and wherein means are provided for forming, on said surface, a latent electrostatic image by imparting a first charge of a given polarity and potential over said surface and for subsequently exposing non-image areas of said cylinder surface to dissipate said first charge in said non-image areas of said surface to form, in said non-image areas, a second charge of lesser potential than and common polarity with said first charge, the improvement comprising:

developer electrode means comprising a liquid toner inlet means and feed means for supplying a liquid toner dispersion to said cylinder surface, said liquid toner dispersion comprising a carrier liquid, and, dispersed therein, solids, color-imparting particles of opposite polarity than said given polarity, means for imparting a third charge to said developer electrode of common polarity with said first charge and having a potential intermediate that of said first and second charge, means for feeding said liquid toner dispersion to said developer electrode for application to said cylinder surface at sufficient velocity to inhibit agglomeration of said solids, color-imparting particles on said developer electrode, and further comprising biasing means for normal biasing said developer electrode into an operable position closely spaced from and adjacent to said surface.

21. Apparatus as recited in claim 20 wherein in said operable position said developer electrode is spaced about 500 microns from said cylinder surface.

22. Apparatus as recited in claim 20 further comprising a pair of bracket members, said developer electrode mounted on said bracket members, each said bracket member mounted on a pivot shaft, said pivot shaft spaced from and extending transversely across said cylinder parallel to the axis of said cylinder, said biasing means comprising spring members attached to said bracket members and normally biasing said developer shoe in said operable position.

23. Apparatus as recited in claim 19 further comprising a pair of bracket members, said developer electrode mounted on said bracket members, each said bracket member mounted on a pivot shaft, said pivot shaft spaced from and extending transversely across said drum surface parallel to the axis of said cylinder, said pivotal attachment means comprising cam means bearing against said bracket members for translating motion of said cam to pivotal movement of said developer electrode about said pivot shaft.

24. High speed electrophotographic printing apparatus of the type including a rotatable cylinder having a photoconductive surface rotating at a peripheral speed of at least about 100 ft./min. and wherein means are provided for forming, on said surface, a latent electrostatic image by imparting a first charge of a given polarity and potential over said surface and for subsequently exposing non-image areas of said cylinder surface to dissipate said first charge in said non-image areas of said surface to form, in said non-image areas, a second charge of lesser potential than and common polarity with said first charge, the improvement comprising:

developer electrode means comprising a liquid toner inlet means and feed means for supplying a liquid toner dispersion to said cylinder surface, said liquid toner dispersion comprising a carrier liquid, and, dispersed therein, solids, color-imparting particles of opposite polarity than said given polarity, means for imparting a third charge to said developer electrode of common polarity with said first charge and having a potential intermediate that of said first and second charge, means for feeding said liquid toner dispersion to said developer electrode for application to said cylinder surface at sufficient velocity to inhibit agglomeration of said solids, color-imparting particles on said developer electrode, and further comprising reverse roller means disposed downstream from said developer electrode means with respect to the rotational direction of said cylinder, said reverse roller normally spaced close to said rotatable cylinder to define a nip location between said roller and said rotatable cylinder, said reverse roller moving in a surface direction opposite from the rotational direction of said cylinder surface in said nip location to shear excess toner from said cylinder surface.

25. Apparatus as recited in claim 24 further comprising a scraper blade in contact with said reverse roller and adapted to scrape liquid toner from said reverse roller.

26. Apparatus as recited in claim 24 further comprising position sensor means for sensing the position of said reverse roller with respect to said cylinder surface and response means responsive to said sensor means for arresting rotational movement of said cylinder upon sensing positioning of said reverse roller in inoperable position.

27. Apparatus as recited in claim 24 further comprising pivotal attachment means for pivotally mounting said reverse roller adjacent said cylinder surface, said pivotal attachment means providing selective, alternate positioning of said reverse roller between a normal operable position in which said reverse roller can shear said excess liquid toner dispersion and an inoperable position in which said reverse roller is spaced farther away from said cylinder than in said operable position.

28. Apparatus as recited in claim 24 further comprising biasing means for normally biasing said reverse roller in its normal, operable position.

29. Apparatus as recited in claim 28 further comprising a pair of bracket plate members, said reverse roller journalled in said bracket plate members, said bracket plate members mounted on brackets disposed on a pivot shaft spaced from and extending transversely across said cylinder and parallel to the axis of said cylinder, said biasing means comprising spring members attached to said bracket, and normally biasing said reverse roller into said operable position.

30. Apparatus as recited in claim 27 further comprising a pair of bracket plate members, said reverse roller journalled in said bracket plate members, said bracket plate members mounted on brackets disposed on a pivot shaft spaced from and extending transversely across said cylinder, said pivotal attachment means comprising cam means bearing against said brackets for translating motion of said cam to pivotal movement of said reverse roller about said pivot shaft.

31. Apparatus as recited in claim 24 comprising means for controlling the surface speed of said reverse roller so that it is about 1.2–1.3 times as fast as the surface speed of said rotatable cylinder.

32. Apparatus as recited in claim 24 comprising delay means for delaying start up commencement of rotation of said photoconductive cylinder until after rotation of said reverse roller so that said debris may be cleaned from said nip location.

33. Reverse roller assembly for use in a high speed electrophotographic printing apparatus of the type including a rotatable cylinder having a photoconductive surface rotating at a peripheral speed of at least about 100 ft./min. and wherein means are provided for forming, on said surface, a latent electrostatic image by imparting a first charge of a given polarity and potential uniformly over said surface and for subsequently exposing non-image areas of said cylinder surface to dissipate said first charge in said non-image areas of said surface to form a second charge of lesser potential than and common polarity with said first charge, and wherein developer electrode means comprising a liquid toner inlet means and feed means for supplying a liquid toner dispersion to said cylinder surface are provided, said liquid toner dispersion comprising a carrier liquid, and, dispersed therein, solids color-imparting particles of opposite polarity than said given polarity, means for imparting a third charge to said developer electrode of common polarity with said first charge and having a potential intermediate that of said first and second charge, said reverse roller assembly being disposed downstream from said developer electrode means with respect to the rotational direction of said cylinder, said reverse roller being normally positioned closely adjacent to said cylinder surface to define a nip location between said reverse roller assembly and said rotatable cylinder, said reverse roller adapted to shear excess liquid toner dispersion from said rotatable cylinder, said reverse roller rotating in a surface direction opposite from the rotational direction of said cylinder surface at said nip location, said reverse roller assembly further comprising sensor means for sensing the position of said reverse roller with respect to said cylinder surface and response means responsive to said sensor means for arresting rotational movement of said cylinder upon sensing positioning of said reverse roller in other than said normal position.

34. Reverse roller assembly as recited in claim 33 further comprising pivotal attachment means for pivotally mounting said reverse roller adjacent said cylinder surface, said pivotal attachment means providing selective, alternate positioning of said reverse roller between said normal, operable position in which said reverse roller is closely spaced from said cylinder surface and capable of shearing excess liquid toner dispersion from said cylinder surface and an inoperable position in which said reverse roller is spaced farther away said cylinder surface.

35. Reverse roller assembly as recited in claim 33 further comprising biasing means for normally biasing said reverse roller in said normal position.

36. Reverse roller assembly as recited in claim 35 further comprising a pair of bracket plate members, said reverse roller journalled in said bracket plate members, said bracket plate members mounted on a pivot shaft spaced from and extending transversely across said cylinder and being parallel to the axis of said cylinder, said biasing means comprising a spring member attached to said bracket and normally biasing said reverse roller into said normal position about said pivot shaft.

37. Reverse roller assembly as recited in claim 34 further comprising a pair of members, said reverse roller journalled in said plate members, said bracket plate members on brackets disposed on a pivot shaft spaced from and transversely across said cylinder, said pivotal attachment means comprising cam means bearing said brackets for translating motion of said cam to pivotal movement of said reverse roller about said pivot shaft.

38. Reverse roller assembly as recited in claim 33 comprising means for controlling the surface speed of said reverse roller so that it is about 1.2–1.3 times as fast as the surface speed of said rotatable cylinder.

39. Reverse roller assembly as recited in claim 38 comprising delay means for delaying start up commencement of rotation of said photoconductive cylinder until after rotation of said reverse roller so that said debris may be cleaned from said nip location.

40. In an electrophotographic printing apparatus of the type in which a rotatable cylinder having a photoconductive surface is provided and wherein a latent electrostatic image is formed on said surface with the image being formed upon the application of a liquid toner dispersion to said surface, a development electrode comprising a housing, an arcuately cross-sectioned face portion of said housing adapted for close positioning adjacent said surface, inlet means communicating with said housing for providing liquid toner dispersion to said housing, a first pair of elongated slots formed transversely across said face of said electrode and in communication with said inlet means for supplying liquid toner dispersion to said surface, a return slot extending transversely across said face and located intermediate said first pair of slots, and elongated gate members adjacent each of said first pair of elongated slots and covering at least a portion of each said elongated slot for restricting liquid toner dispersion flow through said first pair of elongated slots.

41. Apparatus as recited in claim 40 wherein said inlet means comprises four conduits communicating with said first pair of slots, two of said conduits being in communication with one of said first pair of slots and the other two of said conduits being in communication with the other of said first pair of slots.

* * * * *

UNITED STATES PATENT AND TRADEMARK OFFICE

CERTIFICATE OF CORRECTION

PATENT NO. : 5,019,868

DATED : May 28, 1991

INVENTOR(S) : Vincent Kubert, et al.

It is certified that error appears in the above-identified patent and that said Letters Patent is hereby corrected as shown below:

Column 11, Line 24, Claim 2, after "claim" insert --1--.

Column 18, Line 62, Claim 37, after "bearing" insert --against--.

Column 19, Line 1, Claim 39, delete "38" and insert --33--.

Signed and Sealed this

Twenty-second Day of December, 1992

*Attest:*

DOUGLAS B. COMER

*Attesting Officer*

*Acting Commissioner of Patents and Trademarks*